US007011098B2

(12) United States Patent
Byun

(10) Patent No.: US 7,011,098 B2
(45) Date of Patent: Mar. 14, 2006

(54) COSMETICS CASE

(76) Inventor: Young-Kwang Byun, 928-1005, Mok-dong APT, 312 Shinjeong-dong, Yangcheon-ku, Seoul 158-769 (KR)

( * ) Notice: Subject to any disclaimer, the term of this patent is extended or adjusted under 35 U.S.C. 154(b) by 184 days.

(21) Appl. No.: 10/717,520

(22) Filed: Nov. 21, 2003

(65) Prior Publication Data

US 2005/0092343 A1 May 5, 2005

(30) Foreign Application Priority Data

Oct. 30, 2003 (KR) ..... 10-2003-0076178

(51) Int. Cl.
*A45D 33/00* (2006.01)
*A46B 11/00* (2006.01)

(52) U.S. Cl. ..... 132/293; 401/118

(58) Field of Classification Search ..... 132/293, 132/294, 297, 305, 313–314; 215/216–225, 215/228; 401/118, 124, 126–130; 220/212, 220/254.8–254, 255, 259.3–259.5
See application file for complete search history.

(56) References Cited

U.S. PATENT DOCUMENTS 1,715,144 A * 5/1929 Paulson ..... 401/121
2,689,966 A * 9/1954 Reuss ..... 401/125
2,913,017 A * 11/1959 Robineau ..... 141/24
4,446,879 A * 5/1984 Gueret ..... 132/293
4,832,060 A * 5/1989 Kingsford ..... 132/293

* cited by examiner

*Primary Examiner*—John J. Wilson
*Assistant Examiner*—Robyn Doan
(74) *Attorney, Agent, or Firm*—Birch, Stewart, Kolasch & Birch, LLP

(57) ABSTRACT

The present invention relates a cosmetics case for storing color cosmetics in powder state, including a cosmetic aids covered with powdery cosmetics and capable of being fixed to or released from a case body to be freely used by a cover of the case, whereby it attains convenient storage and use thereof.

With regard to constructional aspect of the above cosmetics case, there is a case body formed with a cosmetic receipt member inside and a cover coupling member having a stopper and a shift groove at top side thereof. And, the cosmetics case additionally includes a fitting member having opened bottom part from center of the coupling member toward the receipt member for cosmetics on the case body, which is inclined to be wider at top portion while being narrower at bottom portion thereof. At the top portion of the cosmetics case, a cover having a protrusion corresponding to the shift groove formed around the coupling member inside thereof and formed with an elliptical aperture having a hook member and an opening member, is connected to the cover coupling member only to turn to the right and left directions within desired angles to allow the cosmetic aids to be secured to or released from the cosmetic case to be freely used.

3 Claims, 5 Drawing Sheets

COSMETICS CASE

This non-provisional application claims priority under 35 U.S.C. § 119(a) based on Patent Application No. 2003-0076178 filed in Korea on Oct. 30, 2003, the subject matter of which is herein incorporated by reference.

BACKGROUND OF THE INVENTION

1. Field of the Invention

The present invention relates to a cosmetics case for storing color cosmetics in powder state, and more particularly, to a cosmetics case including a cosmetic aids(=tool) covered with powdery cosmetics and capable of being fixed to or released from a case body to be freely used by turning a cover of the case, whereby it attains convenient storage and use thereof.

2. Description of the Related Art

Generally, any woman outlines vividly or points up desired site of her face by using the color cosmetic after finishing base make-up.

Conventional cosmetics case used to receive such color cosmetics includes a fitting member 105 inclined to fit a cosmetic aids 103 into a case body 101 and a cover 107 screw-connected to the top portion of the case body 101 as shown in FIG. 6.

Conventionally, since the cosmetics case 100 has the case body 101 and the cover 107 individually separated and connected together, the user should firstly hold the case body 101 by one hand and turn the cover 107 several times by the other hand to open it, then take the cosmetic aids 103 out from the fitting member 105 of the case body 101 in order to use the color cosmetics.

Accordingly, the cosmetics case 100 having the above construction which requires turning the cover 107 screw-connected to the top portion of the case body 101 in several times to separate the cover 107 from the case body 101 in order to take the cosmetic aids 103 out of the case 100 to be used, involves some drawbacks such as inconvenience in using caused by opening/closing the cover 107 by both hands, extended time consumption required to separate the cover 107 from the case, possibility of missing the cover 107 if the cover 107 is left in disassembled state after completion of its use, and the trouble of pouring down the cosmetic aids 103 and the powdery color cosmetics contained in the cosmetic aids 103 if the case body 101 comes down without the cover 107.

SUMMARY OF THE INVENTION

It is, therefore, an object of the present invention is to solve the above problems, in particular, to provide a cosmetics case having convenience to carry and use cosmetics, capable of being used to secure a cosmetic aids fitted into a fitting member for the cosmetic aids on a case body of the case or to release it from the fitting member by turning a cover on the top portion of the case body at desired turning angles thereof.

BRIEF DESCRIPTION OF THE DRAWINGS

The above object, features and advantages of the present invention will become more apparent to those skilled in the related art from the following detailed description for preferred embodiments taken in conjunction with the accompanying drawing, in which.

DETAILED DESCRIPTION OF THE PREFERRED EMBODIMENT

The present invention will be described in more detail be reference to the following embodiments which are presented for purpose of illustration and should not be construed to limit the scope of the invention thereto.

Firstly, structural construction of the present invention is described as follows with reference to the accompanying drawings.

Figure 1:
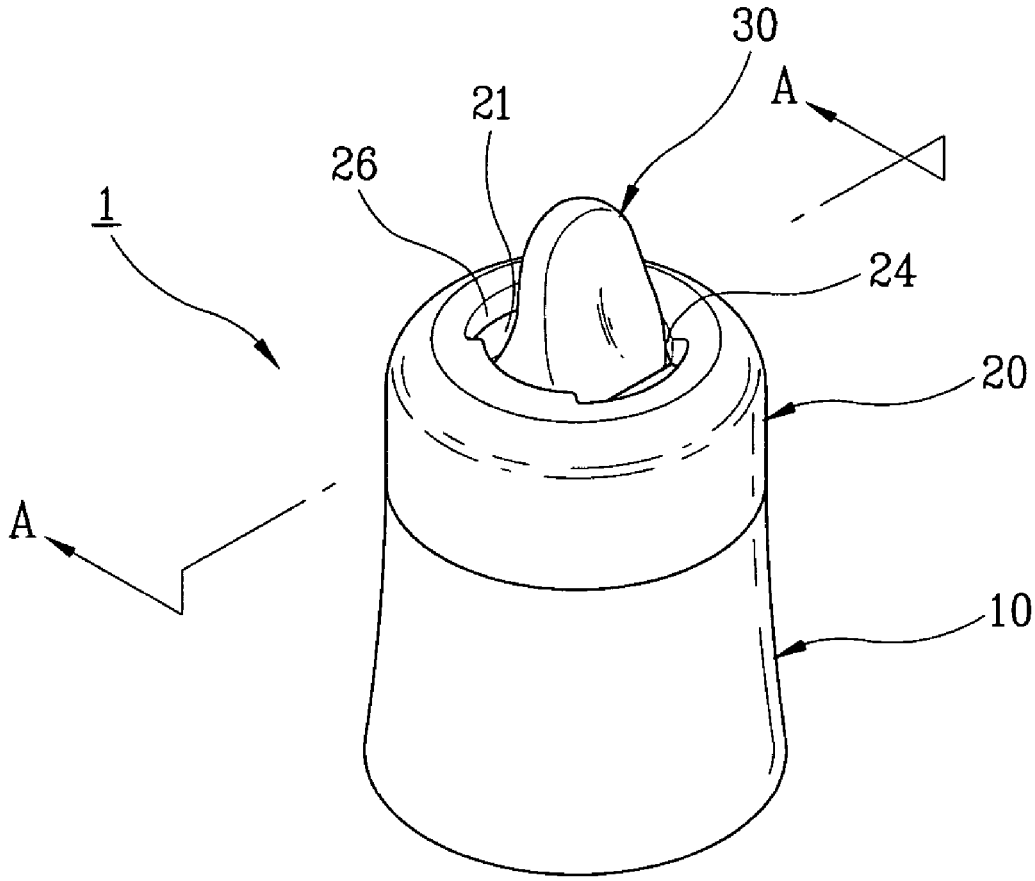
FIG. 1 is a perspective view of a cosmetics case according to the present invention, showing it in an assembly status.
Figure 2:
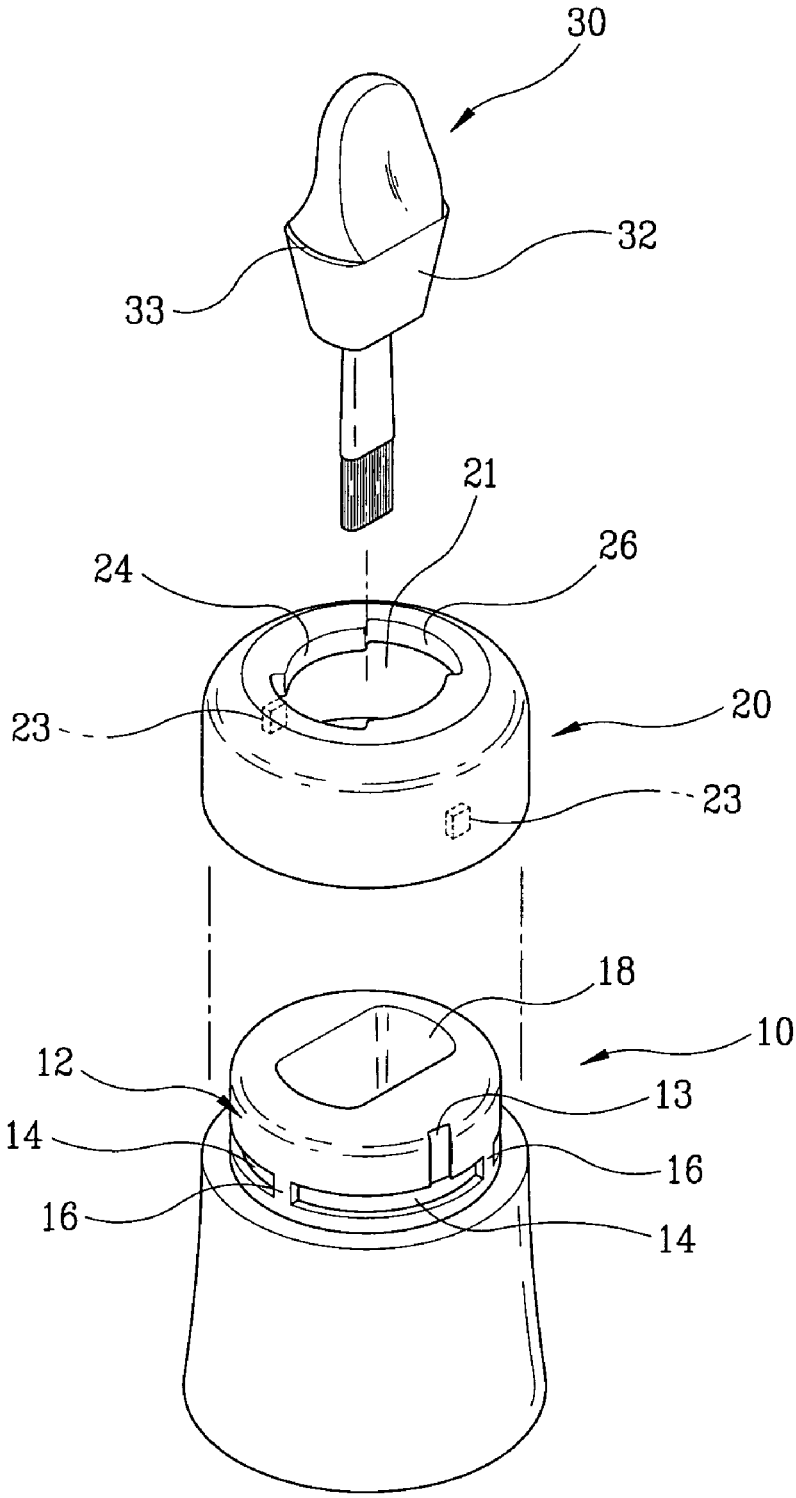
FIG. 2 is an exploded perspective view of the cosmetics case according to the present invention.
Figure 3:
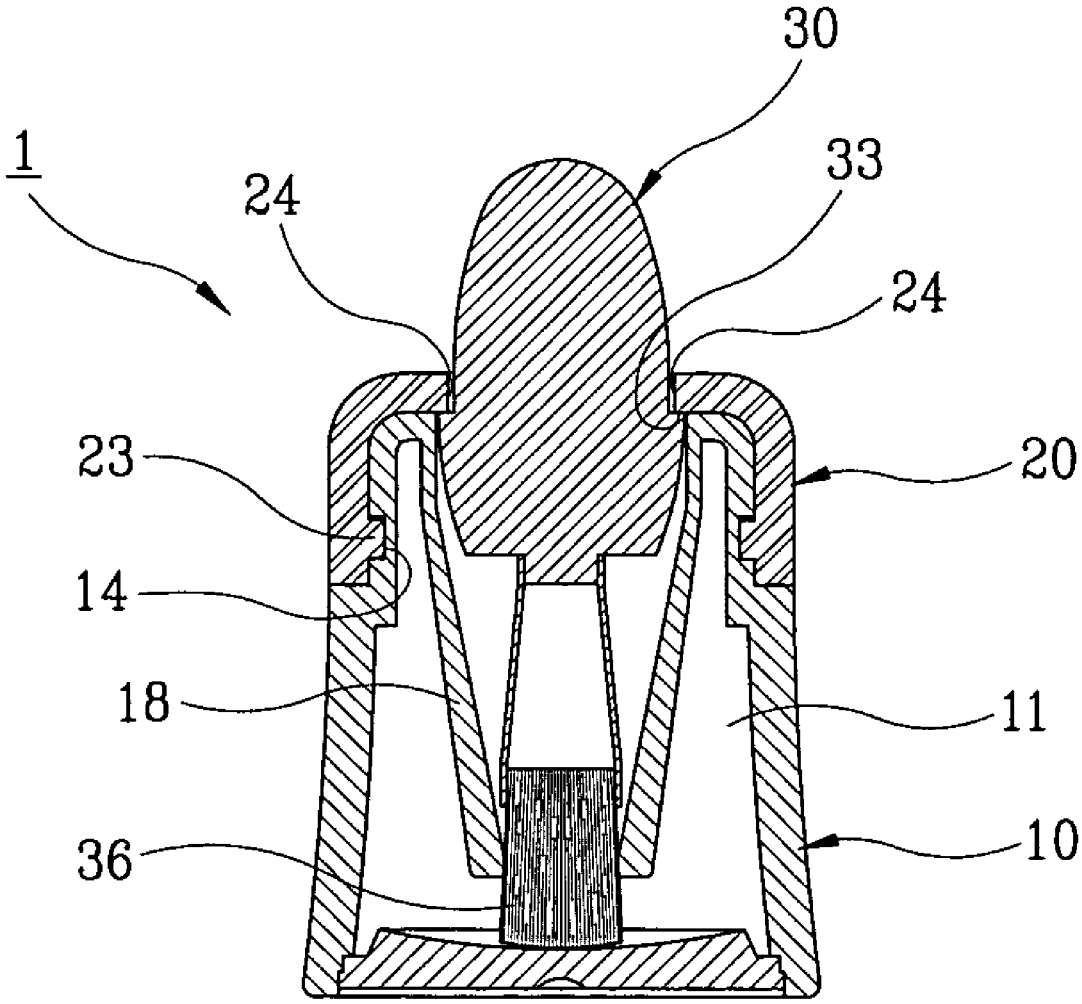
FIG. 3 is a sectional view of the cosmetics case taken along the line A—A of FIG. 1.

FIG. 1 illustrates a perspective view of a cosmetics case according to the present invention, showing it in an assembly status. FIG. 2 illustrates an exploded perspective view of the cosmetics case according to the present invention. FIG. 3 illustrates a sectional view of the cosmetics case taken along the line A—A of FIG. 1.

Referring to FIG. 1, the cosmetics case 1 according to the present invention comprises a case body 10 in a receptacle form and a cover 20 coupled at top portion of the case body 10. At top side of the case body 10, provided are a cover coupling member 12 having a shift groove 14 and a stopper 16, and a fitting member 18 having opened bottom part from center of the coupling member 12 toward a receipt member 11 for cosmetics. The fitting member 18 is inclined to be wider at top portion while being narrower at bottom portion thereof and is connected with a cosmetic aids 30 having a threshold 33.

The cover 20 has a protrusion 23 corresponding to the shift groove 14 formed around the coupling member 12 inside thereof. The protrusion 23 is fitted inside the shift groove 14 to prohibit the case body 10 to be separated from the cover 20 and only to turn to the right and left directions, and formed with an aperture 21 having a hook member 24 and an opening member 26. The aperture 21 is connected to top portion of the threshold 33 on the top portion of the cosmetic aids 30.

With regard to the cosmetics case 1 constructed as above, since it has the cover 20 fitted inside the shift groove 14 on the top portion of the case body 10 by the protrusion 23, the cosmetics case 1 can revolve(=turn) within a region disposed with the stopper 16.

Numerical symbol 13 is defined by a protrusion guiding groove 13 to induce fitting of the protrusion 23 of the cover 20 into the shift groove 14 when the cover 20 is initially assembled with the case body 10.

Practical use and features of the present invention described above will be illustrated as follows:

In order to assemble the cosmetics case according to the present invention, the cosmetic aids 30 is received in the fitting member 18 of the case body 10 then the cover 20 is connected on the top portion of the case body 10. In this case, the protrusion 23 inside the cover 20 is engaged in the shift groove 14 through the protrusion guiding groove 13 formed on the cover coupling member 12 on the top portion of the case body 10.

Figure 4:
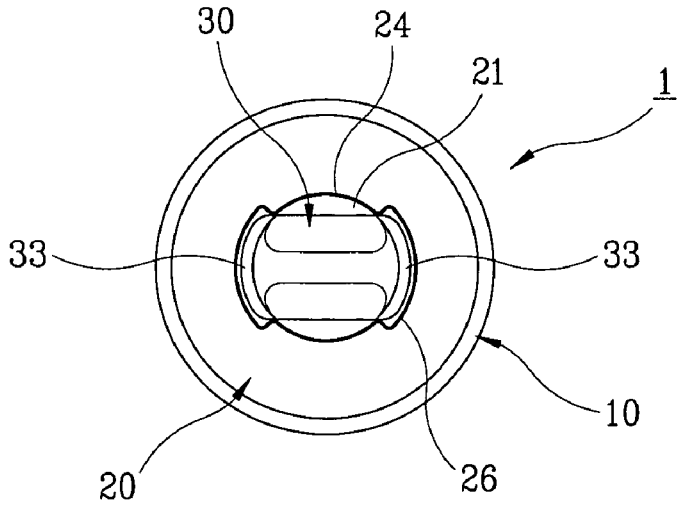
FIG. 4 is a plane view of the cosmetics case according to the present invention, showing the cosmetic aids in a disassembled status by making an opening member formed on a cover to match with a threshold formed on the cosmetic aids of the cosmetics case.

Referring to FIG. 4 illustrating a plane view of the cosmetics case according to the present invention, the cosmetic aids 30 has generally an elliptical form of body 32 with longer side disposed to meet with the opening member 26 of the aperture 21 on the cover 20 to take the cosmetic aids 30 out from the case to be used.

Figure 5:
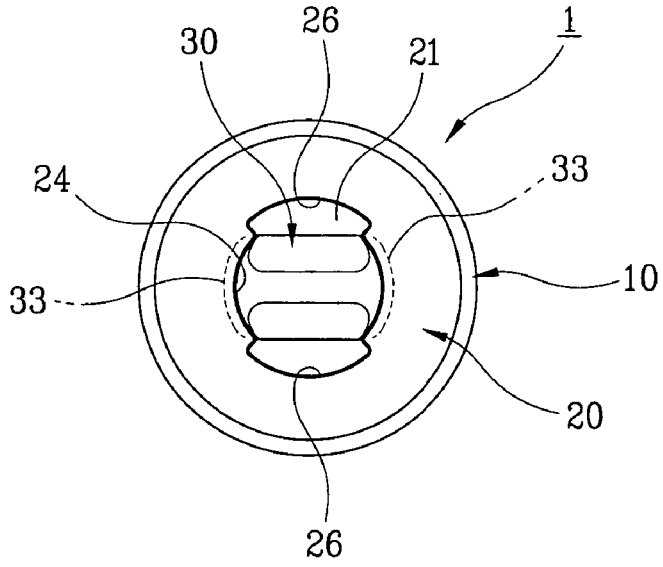
FIG. 5 is a plane view of the cosmetics case according to the present invention, showing the cosmetic aids in an assembled status by making an opening member formed on a cover to match with a threshold formed on the cosmetic aids of the cosmetics case.
Figure 6:
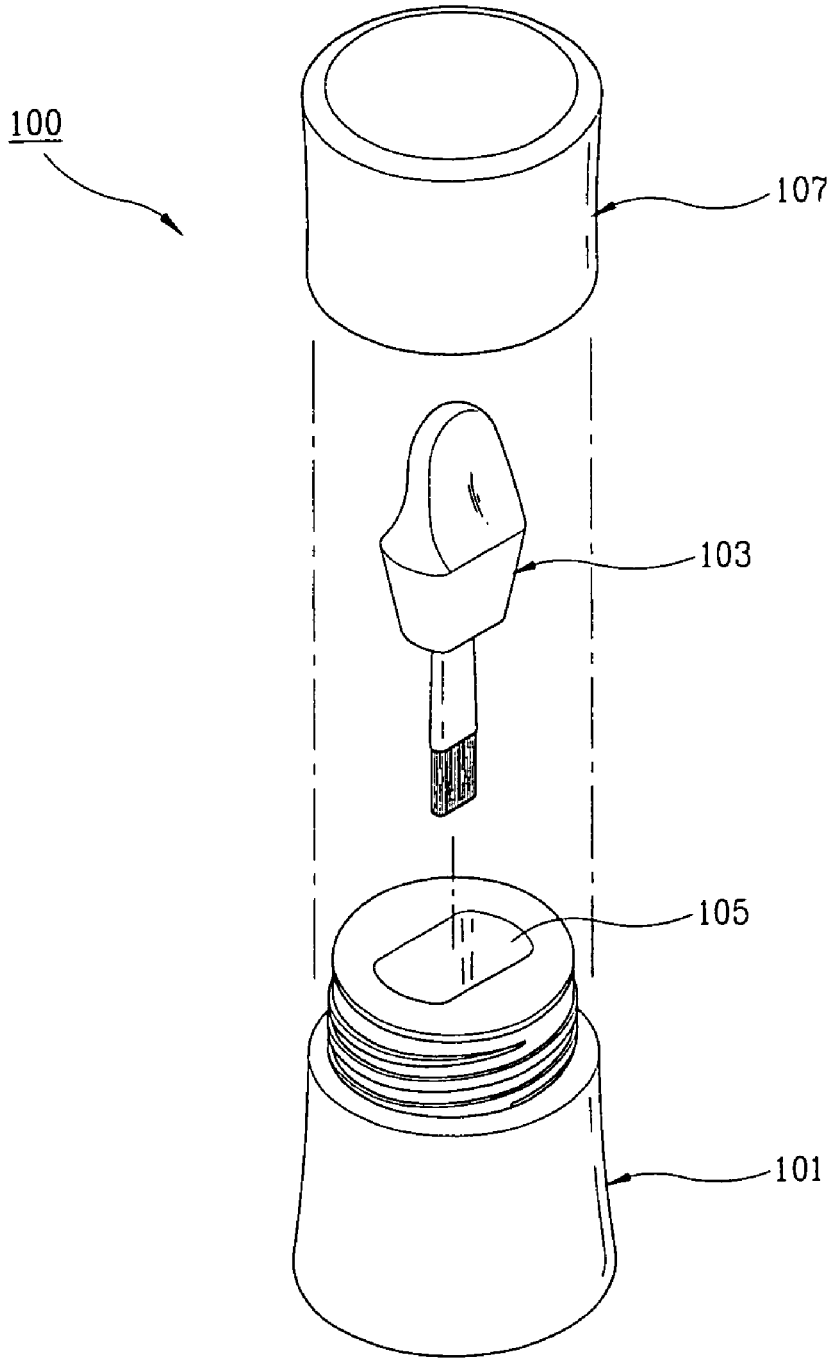
FIG. 6 PRIOR ART
FIG. 6 is an exploded perspective view of a conventional cosmetics case.

When storing the cosmetic aids 30 in the cosmetics case 1, the protrusion 23 inside the cover 20 is turned at 90° angles along the stopper 16 by turning the cover 20 to one side thereof then inhibited not to further revolve by the stopper 16. Additionally, as shown in FIG. 5, the threshold 33 on the top portion of the cosmetic aids 30 contacts to the hook member 24 of the cover 20 to be pressed, thereby securing and connecting the cosmetic aids 30 to the case body 10 to be safely stored in the cosmetics case 1.

Furthermore, referring to FIG. 4 illustrating the cosmetics case 1 in the assembly status, the hook member 24 in the cover 20 is released from the threshold 33 of the cosmetic aids 30 by turning the cover at 90° angles to a direction opposite to the direction as the cosmetic aids 30 is stored, in case of using cosmetics in the cosmetics case 1, whereby the cosmetic aids 30 can be pulled out from the cosmetics case 1 and be used.

As described in detail above, the cosmetics case according to the present invention includes a cosmetic aids covered with powdery cosmetics and capable of being fixed to or released from a case body to freely used by turning a cover of the cosmetics case to the right and left directions within a range of 90° angles, whereby it attains convenient storage and use thereof. In addition to, the cosmetics case of the present invention can eliminate an inconvenience due to loss of the cover in conventional products.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A cosmetics case comprising:

a case body having a fitting member fitted with a cosmetic aids and a cover coupled at top portion of the case body;

a cover coupling member formed with a shift groove and a stopper on top portion of the case body;

a protrusion corresponding to the shift groove inside the cover, the protrusion being fitted and engaged into the shift groove for leading the cover to turn; and an elliptical aperture having a hook member and an opening member provided on the top side of the cover, whereby the cosmetic aids is fixed and released by turning the cover to the right and left directions.

2. The cosmetics case of claim 1, wherein the cover is able to turn to the right and left directions within a range of 90° angles.

3. The cosmetics case of claim 1, wherein the cosmetic aids additionally includes a threshold connected and engaged to the cover at top portion thereof.

* * * * *